United States Patent [19]

Swanson

[11] Patent Number: 4,531,562

[45] Date of Patent: Jul. 30, 1985

[54] INTERIOR WINDOW COVER ASSEMBLY FOR SELECTIVE INSULATING SEALABLE CLOSURE OF A WINDOW OPENING

[75] Inventor: C. D. Swanson, Lansing, Mich.

[73] Assignee: Chemstyle, Inc., Lansing, Mich.

[21] Appl. No.: 231,167

[22] Filed: Feb. 3, 1981

[51] Int. Cl.[3] ..... E04F 10/06; A47H 1/00

[52] U.S. Cl. ..... 160/26; 160/DIG. 7; 160/290 R

[58] Field of Search ..... 160/241, 26, 266–269, 160/290; 428/131, 137, 138

[56] References Cited

U.S. PATENT DOCUMENTS

| | | | |
|---|---|---|---|
| 1,676,327 | 7/1928 | Faulds | 160/269 |
| 1,756,496 | 4/1930 | Warnick | 160/269 |
| 1,892,001 | 12/1932 | Nye | 160/269 |
| 1,911,232 | 5/1933 | Large | 160/290 R |
| 2,134,495 | 10/1938 | Woodall et al. | 428/138 |
| 2,987,103 | 6/1961 | Yakubik | 428/47 |
| 3,097,124 | 7/1963 | Denenberg | 428/138 |
| 3,236,290 | 2/1966 | Lueder | 160/241 |
| 3,398,041 | 8/1968 | Ferree | 428/138 |
| 3,895,983 | 7/1975 | Lang et al. | 428/138 |
| 4,282,919 | 8/1981 | Teno | 160/290 R |

*Primary Examiner*—Peter M. Caun

*Attorney, Agent, or Firm*—George P. Pappas

[57] ABSTRACT

An interior window cover assembly is provided for selective insulating sealable closure of a window opening so as to prevent air infiltration and reduce heat transfer therethrough. The window cover assembly is provided with a pair of vertically oriented spaced-apart track assemblies adapted for opposed sealable engagement with the vertical sides of a window frame. A horizontally oriented spring-actuated window cover roller assembly is pivotally mounted across the top of a window frame in abutting engagement with the upper ends of the track assemblies. A flexible insulating window cover member having a sill closure bar across the bottom thereof is selectively extendable downwardly from the window cover roller assembly so as to cover the window opening. The vertical edge portions of the flexible cover member extend into grooves provided in the track assemblies and are movable therealong as the sill closure bar is moved downwardly to draw the window cover member over the window opening. A cam-actuated seal bar is provided in each track assembly and is substantially co-extensive therewith so as to move into sealable engagement against the entire length of the vertical edges of the window cover member proximate thereto as the sill member is moved into its lowermost fully closed position. A sill bar lock mechanism is provided at the lower end portion of each track assembly to selectively lockably engage the sill closure bar so as to maintain it in its closed sealed position against the window sill while simultaneously locking each cam seal bar into its seal position against the vertical edge of the cover member proximate thereto and drawing the roller assembly housing into sealing engagement across the top of the window cover member.

5 Claims, 19 Drawing Figures

FIG. 12
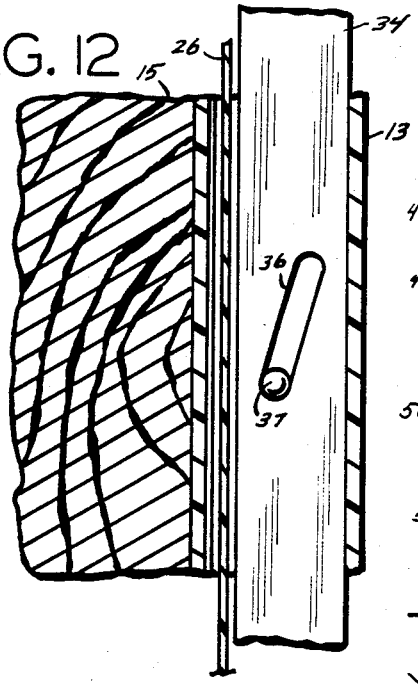
FIG. 13
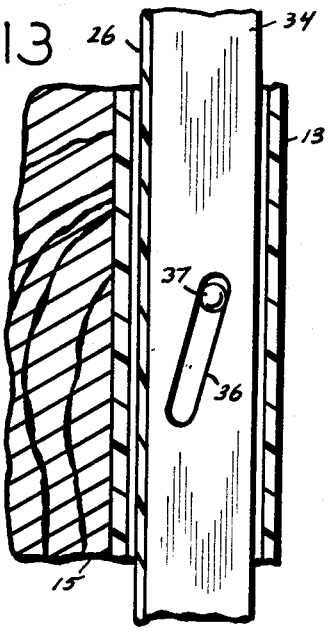
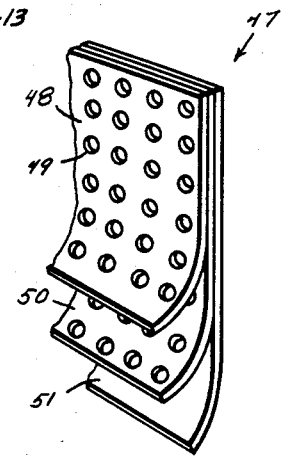
FIG. 18
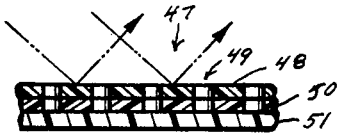
FIG. 19
FIG. 14
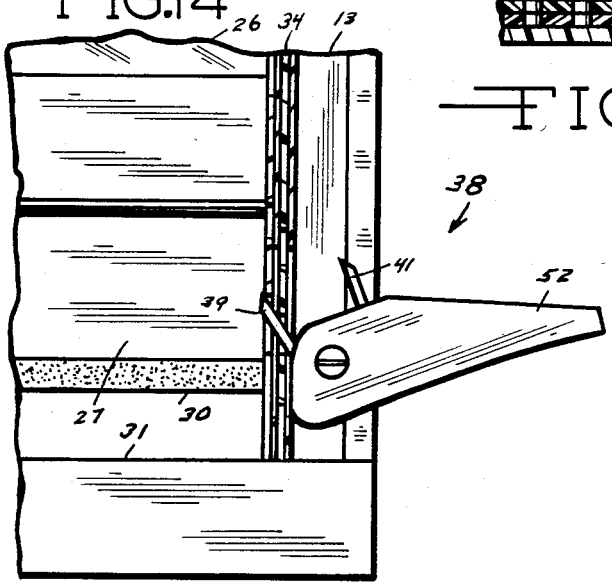
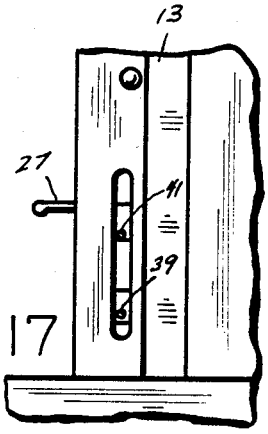
FIG. 17
FIG. 15
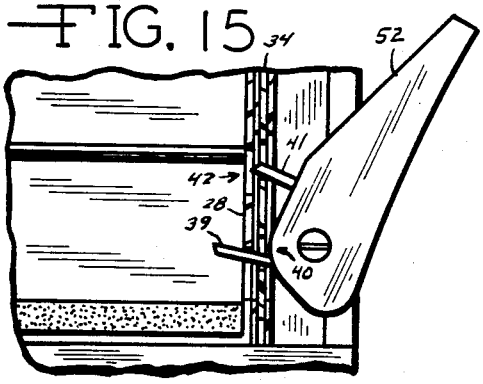
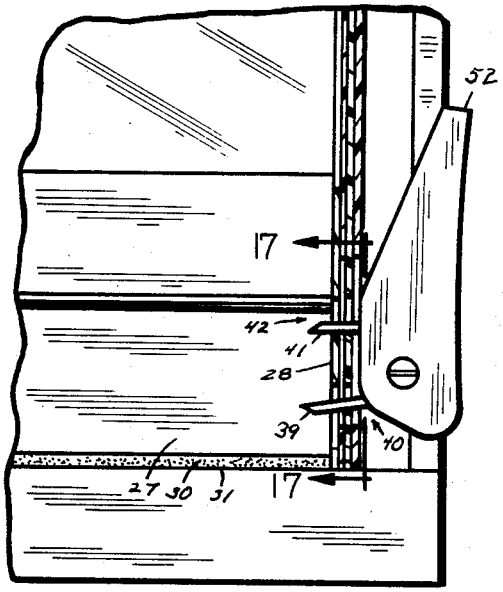
FIG. 16

INTERIOR WINDOW COVER ASSEMBLY FOR SELECTIVE INSULATING SEALABLE CLOSURE OF A WINDOW OPENING

SUMMARY OF THE INVENTION

This invention relates to an interior window cover assembly for selective insulating sealable closure of a window opening so as to prevent air infiltration and reduce heat transfer therethrough. The window cover assembly is provided with a pair of vertically oriented spaced-apart track assemblies adapted for opposed sealable engagement with the vertical sides of a window frame. A horizontally oriented spring-actuated window cover roller assembly is pivotally mounted across the top of a window frame in abutting engagement with the upper ends of the track assemblies. A flexible insulating window cover member having a sill closure bar across the bottom thereof is selectively extendable downwardly from the window cover roller assembly so as to cover the window opening. The vertical edge portions of the flexible cover member extend into mating grooves provided in the track assemblies and are movable therealong as the sill closure bar is moved downwardly to draw the window cover member over the window opening. A cam-actuated seal bar is provided in each track assembly and is substantially co-extensive therewith so as to move into sealable engagement against the entire length of the vertical edges of the window cover member proximate thereto as the sill member is moved into its lowermost fully closed position. A sill bar lock mechanism is provided at the lower end portion of each track assembly to selectively lockably engage the sill bar so as to maintain it in its closed sealed position against the window sill while simultaneously locking each cam seal bar into its seal position against the vertical edge of the cover member proximate thereto. As the flexible cover member is locked into its fully extended locked position over the window opening it is tranversely sealed across the top thereof by engagement with a transversely oriented top seal strip provided along the window cover assembly.

Thus, when the flexible insulating window cover member is fully extended into its down and locked position, the action of the roller housing and the top seal strip, the cam seal bars and the sill closure bar cooperate to provide full perimeter sealed insulating closure of the window opening so as to prevent air infiltration and reduce heat transfer therethrough.

While there are many exterior storm windows or other exterior window insulation structures found in the prior known art, nowhere is there disclosed a self-contained easily mounted interior window cover assembly for selective insulating sealable closure of a window opening. Further, nowhere in the prior known art is there shown a self-contained interior insulating window cover assembly which does not require ancillary mounting means or structures and which can be fully retracted when not in use. In addition, nowhere in the prior known art is there shown an interior window cover assembly having a flexible insulating window cover member with automatic full perimeter sealing when in its fully extended covering position across a window opening.

A need has thus existed for an easily mounted self-contained interior insulating window closure assembly for selective sealable closure of a window opening.

A further need has existed for an insulating window closure assembly having automatic full perimeter sealing when in its fully extended covering position across a window opening.

It is therefore an object of this invention to provide an interior window cover assembly for selective insulating sealable closure of a window opening so as to prevent air infiltration and reduce heat transfer therethrough.

Another object of this invention is to provide a self-contained interior window cover assembly which is easily mounted in its operative use position without the need for ancillary mounting and/or support means.

A still further object of this invention is to provide a flexible interior window cover member having enhanced selective heat absorbing and heat reflective characteristics while permitting illumination and vision therethrough.

Yet another object of this invention is to provide an insulating interior window cover member having automatic full perimeter sealing when in its fully extended covering position across a window opening.

Other objects and advantages found in the construction of the invention will be apparent from a consideration of the following specification in connection with the appended claims and the accompanying drawings.

IN THE DRAWINGS

FIG. 12 is a schematic cross-sectional view of the track assembly showing the cam-actuated seal bar in its upward retracted position away from the flexible cover member.

FIG. 13 is a schematic cross-sectional view of the track assembly showing the cam-actuated seal bar in its downward seal position against the flexible cover member.

FIG. 14 is a schematic cross-sectional view of the lock mechanism in its unlock position showing the lower cam seal bar lock pin and the upper sill bar lock pin provided thereon.

FIG. 15 is a schematic cross-sectional view of the lock mechanism in its partially closed position showing the lower cam seal bar lock pin in operative engagement with a slot provided in the cam-actuated seal bar so as to effect sealing engagement of the seal bar against the flexible closure member.

FIG. 16 is a schematic cross-sectional view of the lock mechanism in its fully closed position showing the upper sill bar lock pin in operative engagement with a slot provided in the sill bar lock extension.

FIG. 17 is a schematic cross-sectional view taken on line 17—17 of FIG. 16.

FIG. 18 is a partial schematic perspective view of the insulating flexible cover member showing its laminated construction.

FIG. 19 is a partial schematic cross-sectional view of the insulating flexible cover member.

DESCRIPTION

Figure 4:
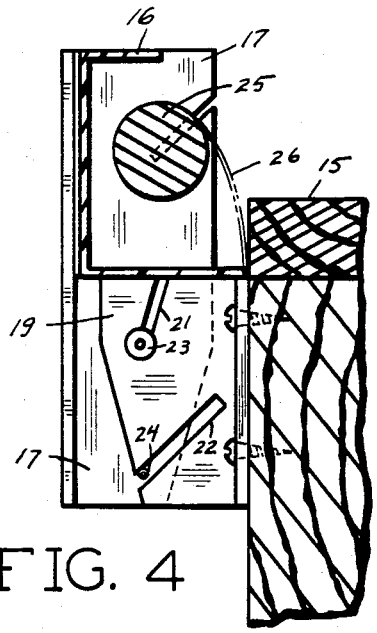
FIG. 4 is a partial cross-sectional schematic view of the window cover roller and housing assembly in its closed operative use position taken on line 4—4 of FIG. 2.
Figure 5:
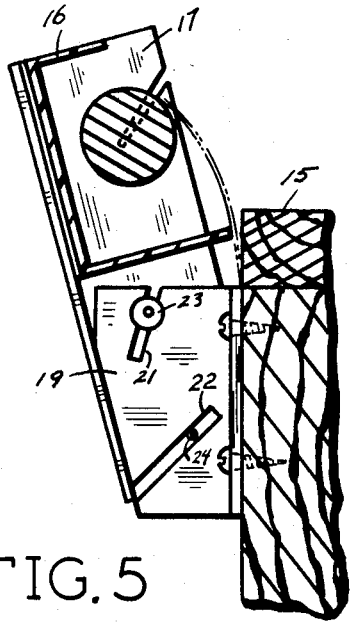
FIG. 5 is a partial cross-sectional schematic view of the window cover roller and housing assembly in its open position taken on line 5—5 of FIG. 2.

As shown in the drawings, the interior window cover assembly 11 comprises a pair of vertically oriented spaced-apart track assemblies 12 and 13, respectively. A horizontally oriented spring-actuated window cover roller assembly 14 is provided across the top of a window frame 15 in substantially abutting engagement with the upper ends of the track assemblies 12 and 13. The window cover roller assembly 14 comprises a horizontally-oriented housing 16 with downwardly extending end cap members 17 and 18, respectively. The end cap members 17 and 18 are in pivotal engagement with and supported by end cap support brackets 19 and 20, respectively, which are fixedly attached to the upper side portions of the window frame 15. Slots 21 and 22 are provided in each of the end cap support brackets 19 and 20 and are configured to slidably receive pins 23 and 24 extending inwardly from the end caps. Thus supported, the window cover roller assembly 14 is free to pivot as shown in FIGS. 4 and 5.

Figure 1:
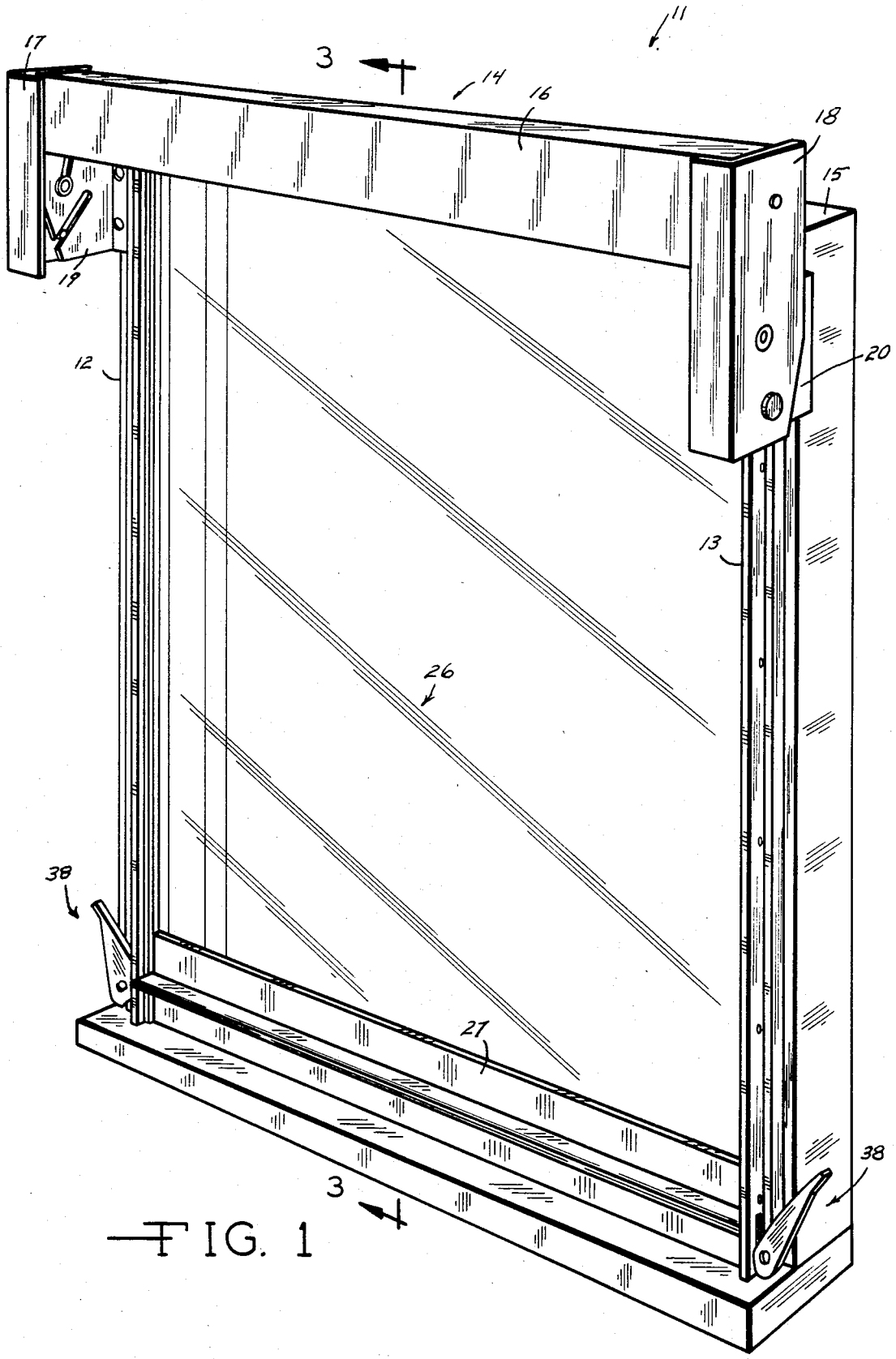
FIG. 1 is a left perspective view of the interior window cover assembly showing the flexible insulating window cover member in its fully extended sealed closure position.
Figure 2:
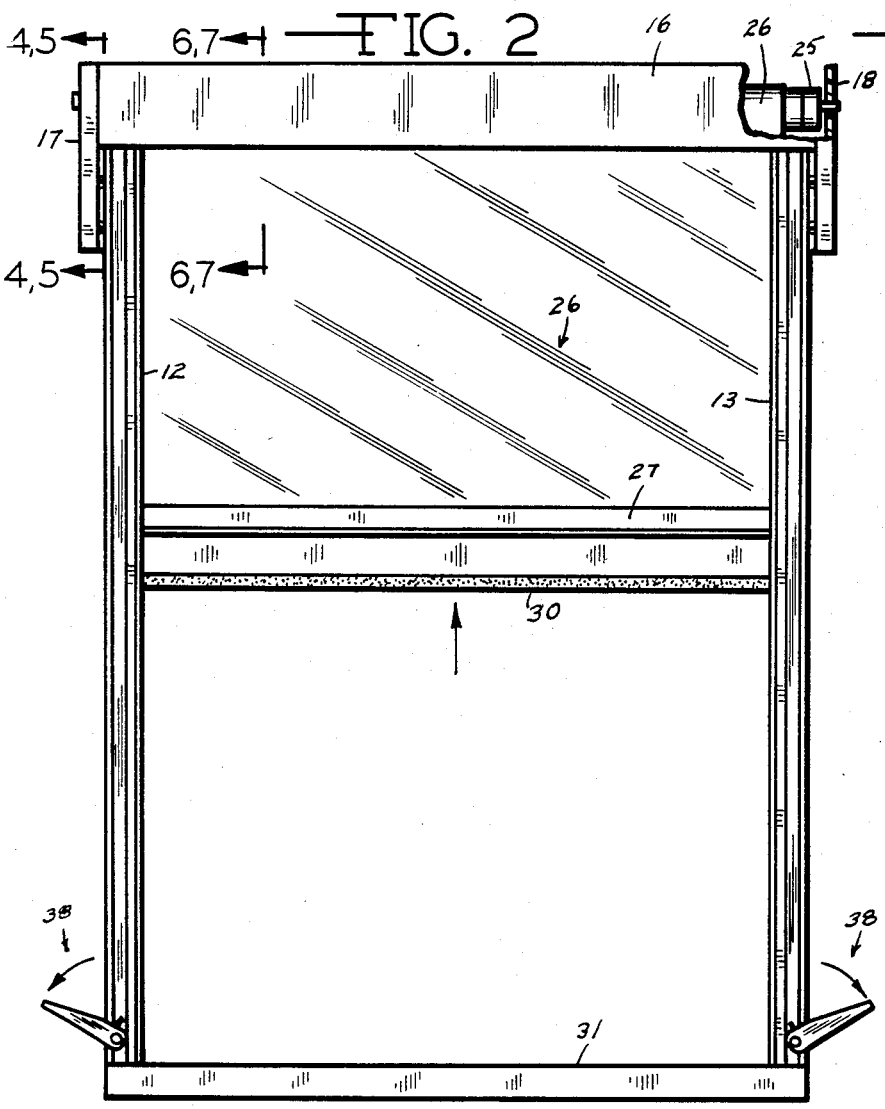
FIG. 2 is a front elevational view of the interior window cover assembly showing the flexible insulating window cover member in its partially drawn position.
Figure 3:
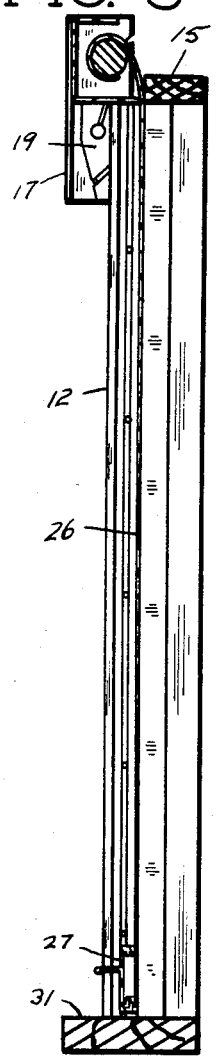
FIG. 3 is a cross-sectional view of the interior window cover assembly taken on line 3—3 of FIG. 1.

As shown in FIG. 2, a constant spring tensioned roller 25 is rollably supported by the end cap members 17 and 18. A flexible window cover member 26 is provided on the roller 25 and is selectively extendable downwardly therefrom across the window opening.

Figure 8:
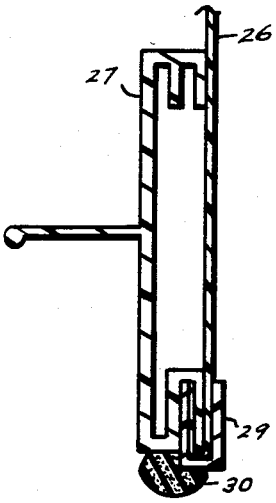
FIG. 8 is a partial cross-sectional schematic view of the sill closure bar provided with a sealing strip along the bottom thereof and showing the window cover member in engagement therewith.
Figure 9:
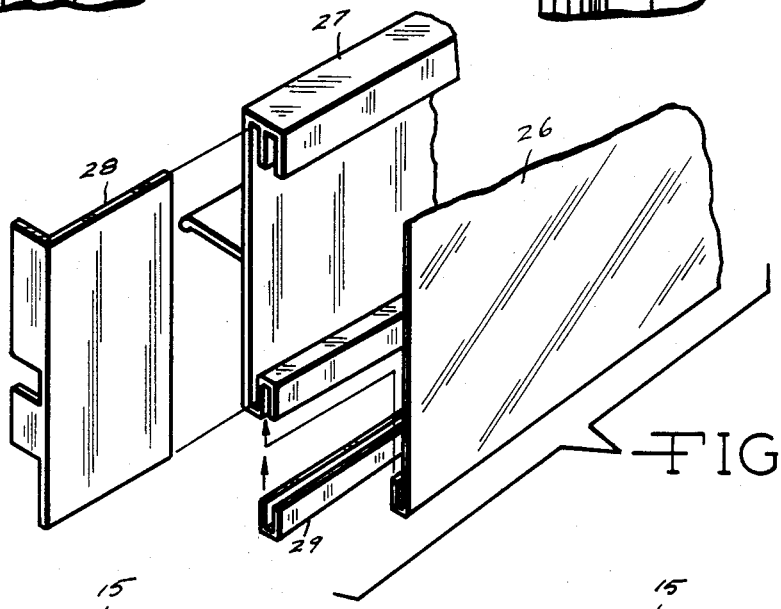
FIG. 9 is an exploded perspective view of the sill closure bar assembly showing the lock engaging extension member and interrelationship of the various components thereof.

As shown in the drawings generally and more specifically in FIGS. 8 and 9, the lower edge of the flexible cover member 26 is attached to a horizontally-oriented sill closure bar 27. A track assembly-engaging sill extension member 28 is slidably provided at each end of the sill closure bar 27. An elongate U-shaped channel member 29 retains the bottom edge of the flexible window cover member 26 in fixed engagement with the sill closure bar 27. A compressible weather strip 30 is provided along the bottom of the sill closure bar 27 so as to enhance the sealing action against a window sill 31 when the sill closure bar 27 is closed thereagainst.

Figure 10:
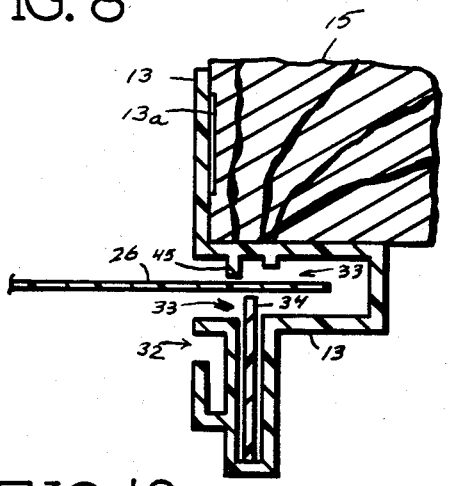
FIG. 10 is a schematic cross-sectional view of the track assembly showing the vertical edge portion of the flexible window cover member extending thereinto with the cam seal bar in its retracted position.
Figure 11:
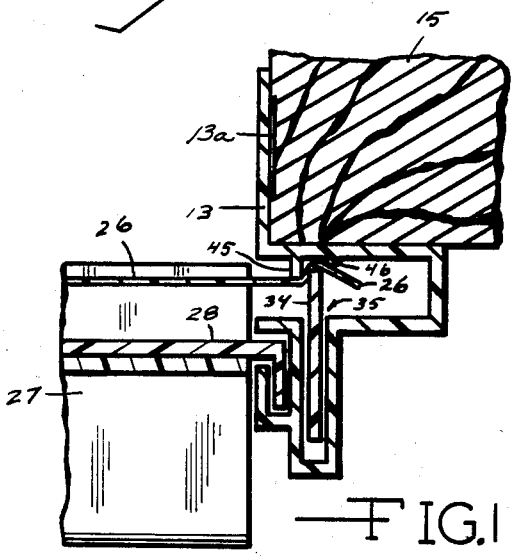
FIG. 11 is a schematic cross-sectional view of the track assembly showing the sill closure bar in sliding engagement with the track assembly and further showing the cam seal bar in its extended sealing engagement with the flexible cover member.

As shown in FIGS. 10 and 11, each of the track assemblies 12 and 13, respectively, are configured to provide a sill extension member groove 32 which is adapted to slidably receive the sill extension member 28 therein. Each of the track assemblies are also configured to provide a flexible window cover member-receiving groove 33 which is adapted to slidably receive the vertical edge portions of the flexible cover member 26 thereinto. A pressure-sensitive adhesive strip 13*a* is provided along each track assembly for sealable engagement thereof against the window frame 15.

As further shown in FIGS. 10 through 13, a vertically oriented cam-actuated seal bar 34 is slidably provided in a cam seal bar groove 35 defined by each of the track assembly members and is substantially coextensive therewith. The cam-actuated seal bar 34 is provided with several uniformly spaced cam slots 36 which are diagonally oriented to operatively engage cam follower ball bearings 37 fixedly mounted within grooves provided in the track assemblies.

As shown generally in the drawings and more specifically in FIGS. 14 through 17, a sill closure bar lock mechanism 38 is pivotally provided at the lowermost portion of each of the track assemblies 12 and 13, respectively. As shown in FIG. 15, a lower seal bar lock pin 39 is provided on the lock mechanism 38 so as to engage a slot 40 provided through the lower portion of the cam-actuated seal bar 34 so as to move the seal bar 34 into locked sealing engagement against the flexible cover member 26. As shown in FIG. 16, an upper sill bar lock pin 41 is provided on the lock mechanism 38 and passes through a clearance slot in the seal bar 34 so as to operatively engage slot 42 provided in the sill extension member 28 so as to lockably maintain the sill closure bar 27 in sealable engagement with the sill 31 of the window frame. As previously stated, the compressible weather strip 30 provided along the bottom of the sill closure bar 27 enhances the sealing action against the window sill 31.

Figure 7:
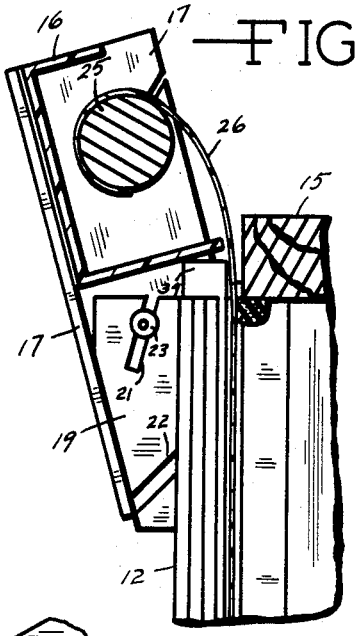
FIG. 7 is a partial cross-sectional schematic view of the window cover roller and housing assembly in its open position in engagement with the retracted cam seal bar taken on line 7—7 of FIG. 2.

When each of the cam-actuated seal bars 34 is in its retracted upward position as specifically shown in FIGS. 7, 10 and 12, it is in spaced-apart register with the vertical edge of the flexible cover member 26 proximate thereto. Further, as shown in FIG. 7, the upper end of the retracted cam-actuated seal bar 34 contacts the lower wall 43 of the housing 16 so as to cause upward and outward pivotal movement of the window cover roller assembly 14 so as to permit free retracting movement of the flexible window cover member 26.

Figure 6:
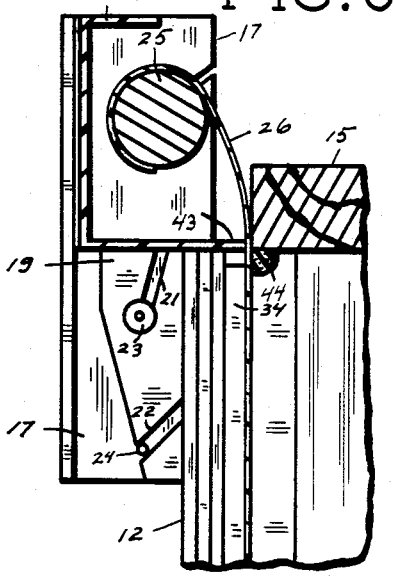
FIG. 6 is a partial cross-sectional schematic view of the closed window cover roller and housing assembly in sealable engagement with the window cover member taken on line 6—6 of FIG. 2.

When the sill closure bar 27 is moved to its lowermost position and the lock mechanism 38 is actuated to move the cam seal bar 34 to its sealed position against the flexible window cover member 26, the upper end of the cam seal bar 34 moves downwardly out-of-engagement with the lower wall 43 of the housing 16. As shown in FIG. 6, the spring action of the roller 25 on the flexible cover member 26 in effect draws the roller assembly 14 into the position shown in FIG. 6 whereby the flexible cover member 26 is sealably engaged between the outer edge of lower wall 43 of the housing 16 and the compressible seal strip 44 positioned along the upper horizontal portion of the window frame 15 in spaced apart and co-extensive register with the edge of the lower wall 43 of the housing 16.

As shown in FIG. 11, when the cam-actuated seal bar 34 is moved into sealing engagement with the vertical edge portion of flexible cover member 26, the flexible window cover member 26 is sealably secured between the vertical edge of the seal bar 34 and the lip seal projections 45 and 46 provided on each of the track assembly members. Thus, an airtight seal is provided along the vertical edge portions of the flexible window cover member 26. This sealing action of each seal bar 34 provided along each of the track assembly members 12 and 13 also serves to provide a stretching and tensioning of the flexible cover member 26 so as to provide for improved optical quality when using transparent material.

It should be noted that the flexible window cover member 26 can be of any material of a flexible and airtight nature. Further, the material utilized can consist of tightly woven fabric or of flexible plastic sheet materials well known in the art, such as polyester, vinyl and the like. The material utilized can be transparent or opaque as desired.

In one embodiment of the invention, the flexible cover member comprises a laminated flexible sheet member 47 having insulating and heat collecting and reflecting characteristics. As shown in FIGS. 18 and 19, the laminated flexible sheet member 47 comprises an outer flexible reflective metallized Mylar plastic layer 48 which is provided with perforations 49 over approximately 30% of its area to allow vision or illumination therethrough. An intermediate flexible black vinyl layer 50 is provided which is also perforated so that the perforations thereof are in register with the perforations 49 provided in the outer reflective layer 48. An inner flexible transparent polyester plastic layer 51 is provided which is solid so as to render the entire laminated flexible sheet member airtight while permitting illumination and vision therethrough by virtue of the perforations 49 provided in the layers 48 and 50.

During the summer season, the laminated flexible sheet member 47 is mounted on the roller 25 so that the metallized reflective layer 48 faces outwardly, thus reflecting the sun's rays back to the exterior of the window opening. This keeps a substantial portion of exterior heat out of the interior of the structure, thus efficiently reducing the heat loads on the cooling system.

During the winter season, the laminated flexible sheet member 47 is reversed on the roller 25 so that the metallized reflective layer 48 faces inwardly, thus reflecting the interior heat back into the interior of the structure. The laminated flexible sheet member 47 also acts as a passive solar heat collector by virtue of the intermediate black vinyl layer 50 which absorbs the heat from the sun's rays. Such solar heat is radiated through the reflective layer 48 into the interior of the structure. Thus, the use of the laminated flexible sheet 47 in association with the interior window cover assembly 11 not only provides selective airtight sealable closure of a window opening, but also provides an insulating cover member having selective heat reflective and solar heat collecting capabilities. The resulting combination results in substantial energy cost savings hitherto not attainable in conventional window and storm window systems.

It is thus seen that a highly utilitarian interior window cover assembly is provided for selective insulating sealable closure of a window opening. As stated previously, a pair of vertically oriented spaced-apart track assemblies are provided for opposed sealable engagement along the sides of a window frame defining a window opening. A horizontally oriented spring-actuated window cover roller assembly is pivotally mounted across the top of the window frame in abutting engagement with the upper ends of the track assemblies. A flexible window cover member is rollably mounted in association with the roller assembly so as to be selectively extendable downwardly therefrom so as to cover the window opening. The vertical edge portions of the window cover member are in slidable engagement with the track assemblies. A horizontally oriented sill closure bar is provided in engagement with the lower portion of the flexible window cover member. The sill closure bar is in slidable engagement at each end thereof with the track assemblies. A vertically oriented cam-actuated seal bar is provided in each of the track assemblies. Easch of said seal bars is selectively extendable into sealable engagement with the vertical edge portions of the flexible cover member extending into said track assemblies. Each of said seal bars is selectively retractable into engagement with the window cover roller assembly so as to cause lifting pivotal movement thereof. An actuating lock mechanism is provided at the bottom of each of the track assemblies so as to lockably retain the sill closure bar in its sealed closure position against the sill of the window. The actuating lock mechanism is adapted to substantially simultaneously selectively actuate the seal bar downwardly and outwardly into sealable engagement with the vertical edge portions of the flexible cover member. The actuating lock mechanism is adapted to substantially simultaneously selectively actuate the seal bar downwardly and outwardly out of engagement with the window cover roller assembly so as to permit transverse sealable engagement thereof with the upper portion of the flexible window cover member. Each of the vertically oriented cam-actuated seal bars are selectively upwardly retractable so as to liftably engage and move the window cover roller assembly out of sealable engagement with the flexible window cover member. Each of the seal bars are downwardly extendable out of engagement with the window cover roller assembly so as to permit the window cover roller assembly to move into sealable engagement with flexible window cover member.

The window cover roller assembly is comprised of an elongate horizontally oriented housing having vertically oriented end cap members provided at each end thereof. The end cap members are pivotally supported by end cap support brackets fixedly mounted at the upper corners of the window frame. A constant spring tensioned roller is rollably supported at the ends thereof by the end cap members. The roller is provided with a flexible window cover member thereon. The flexible window cover member is selectively extendable downwardly from the roller. The actuating lock mechanism comprises an actuating lock arm 52 which is pivotally mounted at the bottom portion of each of the track assembly members. A lower seal bar lock pin is provided on the actuating lock arm. The lower seal bar lock pin is adapted for actuating engagement with the seal bar upon actuation of the lock arm. An upper sill bar lock pin is provided on the actuating lock arm. The upper sill bar lock pin is adapted for actuating locking engagement with the sill closure bar.

An insulating laminated flexible window cover member is provided which comprises an outer flexible reflective metallized plastic layer having first perforations therethrough. An intermediate black vinyl plastic layer is provided with second perforations therethrough. The second perforations are in substantial register with the first perforations provided in the outer layer. An inner flexible transparent solid plastic layer is provided so as to prevent transmission of air through said intermediate layer and said outer layer.

Various other modifications of the invention may be made without departing from the principle thereof. Each of the modifications is to be considered as in the hereinafter appended claims, unless these claims by their language expressly provide otherwise.

I claim:

1. In an interior window cover assembly for selective insulating sealable closure of a window opening comprising:

a pair of vertically oriented spaced-apart track assemblies for opposed sealable engagement along the sides of a window frame defining a window opening;

a horizontally oriented spring-actuated window cover roller assembly pivotally mounted across the top of a window frame in abutting engagement with the upper ends of the said track assemblies;

a flexible window cover member rollably mounted in association with said roller assembly so as to be selectively extendable downwardly therefrom so as to cover said window opening, the vertical edge portions of said window cover member being in slidable engagement with said track assemblies;

a horizontally oriented sill closure bar provided in engagement with the lower portion of said flexible window cover member, said sill closure bar in slidable engagement at each end thereof with said track assemblies;

a vertically oriented cam-actuated seal bar provided in each of said track assemblies, each of said seal bars selectively extendable into sealable engagement with said vertical edge portions of said flexible cover member extending into said track assemblies, each of said seal bars selectively retractable into engagement with said window cover roller assembly so as to cause lifting pivotal movement thereof; and an actuating lock mechanism provided at the bottom of each of said track assemblies so as to lockably retain said sill closure bar in its sealed closure position, said actuating lock mechanism adapted to substantially simultaneously selectively actuate said seal bar downwardly and outwardly into sealable engagement with said vertical edge portions of said flexible cover member, said actuating lock mechanism adapted to substantially simultaneously selectively actuate said seal bar downwardly and outwardly out of engagement with said window cover roller assembly so as to permit transverse sealable engagement thereof with the upper portion of said flexible window cover member.

2. In the interior window cover roller assembly of claim 1 wherein each of said vertically oriented cam-actuated seal bars are selectively upwardly retractable so as to liftably move said window cover roller assembly out of sealable engagement with said flexible window cover member, each of said seal bars being downwardly extendable out of engagement with said window cover roller assembly so as to permit said window cover roller assembly to move into sealable engagement with said flexible window cover member.

3. In the interior window cover assembly of claim 1 wherein said window cover roller assembly comprises:

an elongate horizontally oriented housing having vertically oriented end cap members provided at each end thereof, said end cap members pivotally supported by end cap support brackets fixedly mounted on said window frame; and a constant spring tensioned roller rollably supported at the ends thereof by said end cap members, said roller having a flexible window cover member provided thereon, said flexible window cover member selectively extendable downwardly from said roller.

4. In the interior window cover assembly of claim 1 wherein said actuating lock mechanism comprises:

an actuating lock arm pivotally mounted at the bottom portion of each of said track assembly members;

a lower seal bar lock pin provided on said actuating lock arm, said lower seal bar lock pin adapted for actuating engagement with said seal bar upon actuation of said lock arm; and an upper sill bar lock pin provided on said actuating lock arm, said upper sill bar lock pin adapted for actuating locking engagement with said sill closure bar.

5. An insulating laminated flexible window cover member comprising:

an outer rollably flexible reflective metallized plastic layer provided with first perforations therethrough;

an intermediate rollably flexible black vinyl plastic layer provided with second perforations therethrough, said second perforations being substantially in register with said first perforations; and an inner rollably flexible transparent solid plastic layer provided so as to prevent transmission of air through said intermediate layer and said outer layer.

* * * * *